US005553942A

United States Patent [19]

Domke et al.

[11] Patent Number: 5,553,942

[45] Date of Patent: Sep. 10, 1996

[54] LAMINATE FOR PRODUCING PACKAGING CONTAINERS

[75] Inventors: Klaus Domke, Ditzingen; Herbert Stotkiewitz, Bietigheim-Bissingen; Guenther Voegele, Schoenaich; Bernd Neugart, Leutenbach; Mathias Duelfer, Remshalden; Jelco Klimaschewski, Fellbach; Daniel Schulz, Baden-Baden; Michael Eidher, Rudersberg, all of Germany

[73] Assignee: Robert Bosch GmbH, Stuttgart, Germany

[21] Appl. No.: 403,524

[22] Filed: Mar. 13, 1995

[30] Foreign Application Priority Data

Mar. 11, 1994 [DE] Germany ..... 44 08 244.4

[51] Int. Cl.[6] ..... B65D 33/01

[52] U.S. Cl. ..... 383/101; 383/103; 383/109

[58] Field of Search ..... 383/100, 101, 383/102, 103, 109, 116

[56] References Cited

U.S. PATENT DOCUMENTS

| | | | |
|---|---|---|---|
| 2,593,328 | 4/1952 | Meaker | 383/101 |
| 3,092,249 | 6/1963 | Chapman | 383/102 X |
| 3,503,497 | 3/1970 | Riely et al. | 383/102 X |
| 4,134,535 | 1/1979 | Barthels et al. | 383/102 |
| 4,470,153 | 9/1984 | Kenan | 383/101 |
| 4,550,441 | 10/1985 | Keppel | 383/103 |
| 5,399,022 | 3/1995 | Sheets | 383/103 |

FOREIGN PATENT DOCUMENTS

| | | | |
|---|---|---|---|
| 524539 | 1/1993 | European Pat. Off. | 383/103 |
| 148436 | 5/1981 | Germany | 383/102 |

*Primary Examiner*—Jes F. Pascua

*Attorney, Agent, or Firm*—Edwin E. Greigg; Ronald E. Greigg

[57] ABSTRACT

A packaging container comprises a foil laminate comprising at least two layers in which openings are formed. The two layers are joined together over their entire surface area, except for in a striplike channel. A valve strip is disposed in the channel and in valvelike fashion covers the openings of the inner layer. If there is an overpressure in the packaging container resultant gas can escape into the open through the openings and the valve strip acts like an overpressure valve. As a result of the specialized disposition and embodiment of the valve strip and of the openings, a reliable escape of gas produced is achieved.

20 Claims, 3 Drawing Sheets

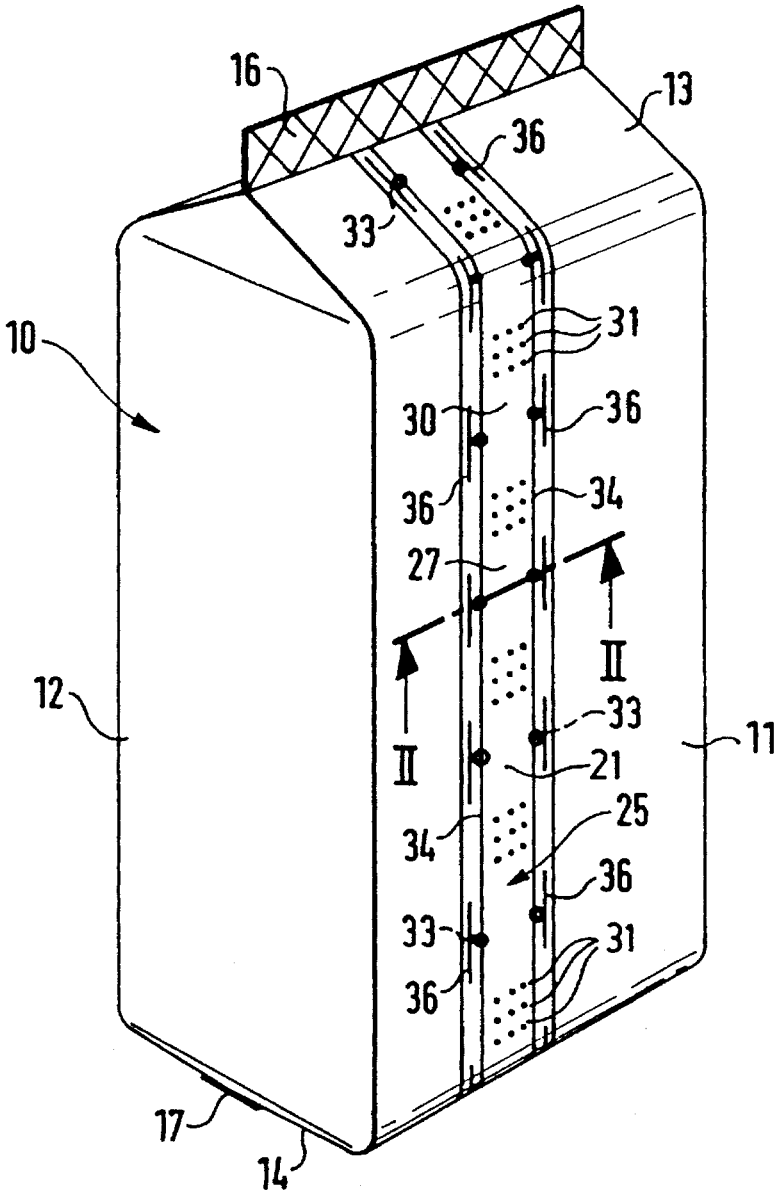
FIG. 1
FIG. 2
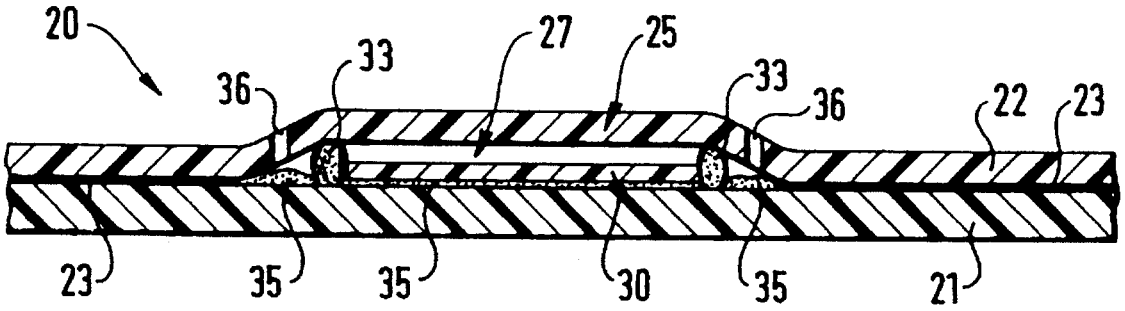

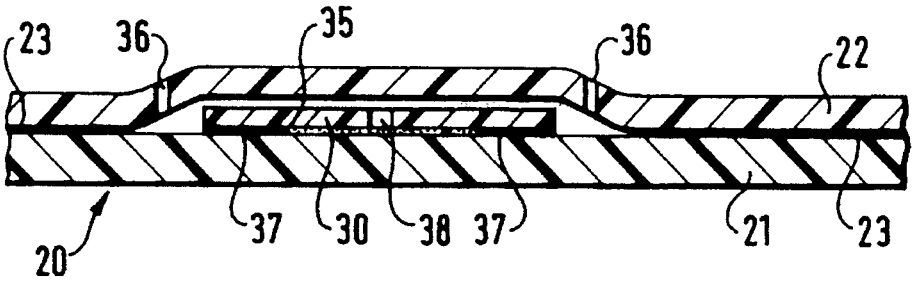
FIG. 5
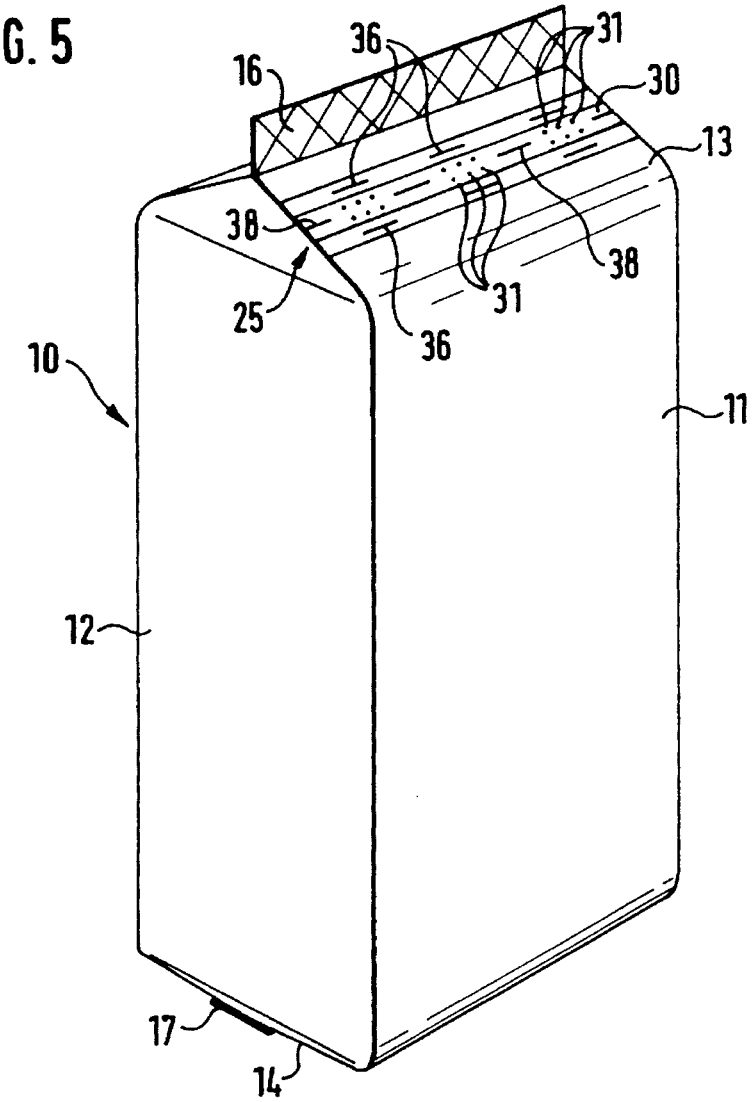
FIG. 6
FIG. 7
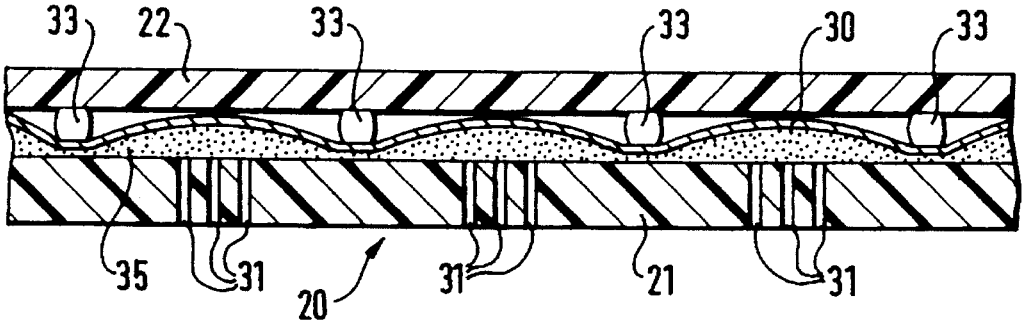

LAMINATE FOR PRODUCING PACKAGING CONTAINERS

BACKGROUND OF THE INVENTION

The invention is based on a laminate for producing packaging containers as defined hereinafter. In a laminate of this type, known from European Patent application EP 0 144 011 B1, the inner layer and the outer layer in a longitudinal strip are not joined together, thus forming a channel. Also, perforations are formed in the inner laminate layer that is in contact with the product. Gas released by the packed product, such as carbon dioxide in the case of coffee, flows through the perforations into the channel when there is overpressure in the packaging container, and from there flows out into the open through openings at the ends of the channels into the edges of the top or bottom region of the package. A disadvantage of this laminate is that because of the relatively great length of the channel and because there are creases at the top and bottom and near the closure seams of the packaging container, which is embodied as a bag package, strains in the material engender choke points; because of these choke points, the opening pressure of the overpressure valve is set to be quite high. On the other hand, an overpressure that exceeds 10 mbar, for instance, inflates the bag package so much that it becomes unattractive, and some consumers might even suspect that the goods in it are spoiled.

To overcome this disadvantage, German Utility Model DE-GM 87 04 279 discloses providing perforations, through which the gas can escape, and which are offset from the perforations in the inner laminate layer, in the outer laminate layer as well. This makes for short paths for the gas and hence a lower opening pressure. Nevertheless, in such bag packages it can happen that if the package walls are deformed, the channels will be compressed as a result of strains. This means that safe and reliable escape of the gas is no longer assured.

OBJECT AND SUMMARY OF THE INVENTION

The laminate according to the invention for producing packaging containers has an advantage over the prior art that the gas produced can safely escape through the valve strips that reinforce the valve region, even if the walls of the packaging container should become unfavorably deformed.

Further advantages and advantageous features of the laminate according to the invention for producing packaging containers will become apparent from the claims and the specification. An even more reliable function of the valve strip can be attained by means of spacers disposed in its peripheral regions. In another embodiment of the laminate according to the invention, in which the spacers are omitted, openings for the gas are also provided in the valve strip. This simplifies the makeup of the laminate, and the overpressure valve formed by the laminate and the valve strip can even be disposed in the top region of a bag package.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 shows a bag package in a perspective view;

FIG. 2 is a partial section taken along the line II—II of FIG. 1;

FIG. 5 is a partial section taken along the line II—II of FIG. 1, in a modified embodiment of the overpressure valve;

FIG. 6 shows a modified bag package in a perspective view; and

FIG. 7 shows a portion of an opened overpressure valve of FIG. 4.

DESCRIPTION OF THE PREFERRED EMBODIMENTS

Figure 3:
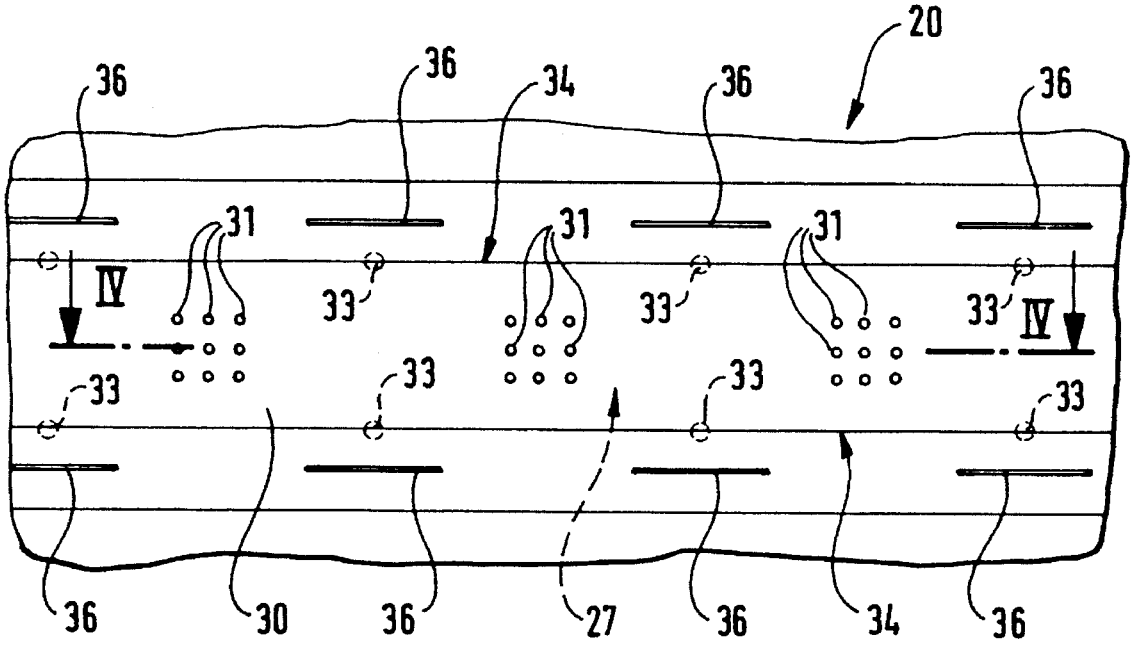
FIG. 3 is a detail of a portion of FIG. 1 in a front view.
Figure 4:
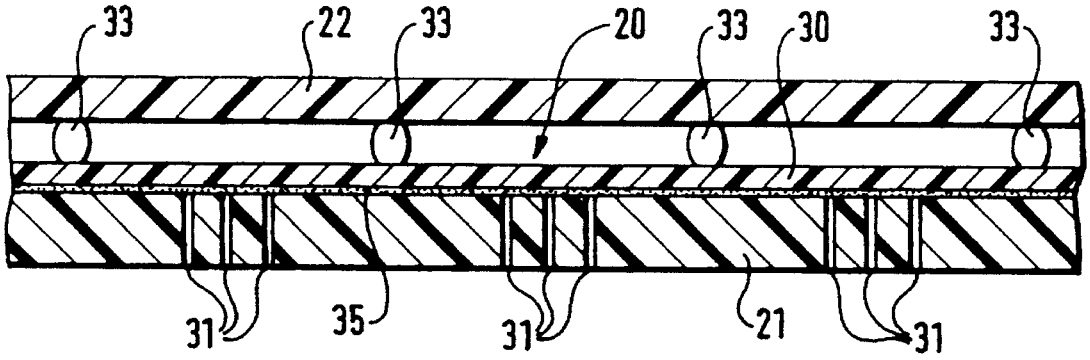
FIG. 4 is a partial section taken along the line IV—IV of FIG. 3.

A bag package 10, shown in FIG. 1, is shaped from a flexible packaging film or foil in which the enveloping bag has two broad side walls and two narrow side walls 11, 12, respectively, as well as a top 13 and a bottom 14. The top 13 and bottom 14 are sealed gas-tight by means of one crosswise seam 16, 17 each, and a side wall is sealed gas-tight with a longitudinal seam, not shown, so that the packaged product, such as coffee, is isolated from the ambient air.

The packaging film or foil (FIG. 2) used to form the bag package 10 comprises a film or foil laminate 20, or multilayer packaging material, which has at least two layers 21, 22. In order to increase the tightness of the bag package 10 for high-quality oxygen-sensitive products, the packaging material may also have more than two layers. The layers 21, 22 preferably comprise an elastic thermoplastic plastic that can be heat-sealed or welded. To increase the gas tightness, one of the layers 21, 22 or one additional layer may comprise a thin metal foil. The various layers 21, 22 are joined together with a layer 23 of some suitable adhesive.

To prevent the gas-tight-closed bag package 10 from being blown up too severely or even exploding when the product enclosed in it releases gas, such as carbon dioxide in the case of coffee, the bag package 10 has a degassing or overpressure valve 25, through which if there is overpressure gas can flow from the interior of the bag package out into the open, but which prevents the entry of air into the interior of the bag package.

The overpressure valve 25 is installed in the packaging material making up the bag package 10 (FIG. 3). To that end, in the region of one of the side walls 11, 12 of the bag package 10, in the multilayer packaging material in which the various layers 21, 22 are joined together essentially over their entire surface area with the adhesive layer 23, the two layers 21, 22 are not joined together in a longitudinal strip, so that in the region of that strip a bubble in the form of a channel 27 is formed. A valve strip 30, whose width is less than that of the channel 27, is disposed centrally in the channel 27. The valve strip 30, which reinforces the region of the channel 27, comprise polyester by way of example and has a thickness of 20 μm to 100 μm.

Coinciding with the valve strip 30, there are openings 31 in the inner layer 21, which are each in the form of a group of openings 31 spaced apart at regular intervals from one another. The valve strip 30 is joined to at least one of the two layers 21, 22 and fixed on its peripheral region by means of so-called hot-melt points 33 made of hot-melt adhesive, so that between the various hot-melt points 33, the inner layer 21 and the valve strip 30, passageway regions 34 are produced for the gas in the region of the channel 27 that is not covered by the valve strip 30. Openings 36 each in the form of a slit are also formed at regular intervals in the outer layer 22 in the region of the channel 27. In this exemplary embodiment, these are disposed on both sides of the valve strip 30, but they may also be disposed to coincide with the valve strip.

Advantageously, the hot-melt points 33 which have a certain thickness, such as 0.2 mm, are disposed at the level of the openings 36 in the outer layer 22.

Preferably a layer of liquid sealant 35, such as silicone oil, is also applied to the side of the valve strip 30 toward the inner layer 21; it fills out irregularities in the layer surfaces and by adhesion pulls the valve strip 30 against the inner layer 21.

In another exemplary embodiment of the film or foil laminate 20 (FIG. 5), the valve strip 30 is joined on its long sides over along its surface area to the inner layer 21, for instance by means of two adhesive layers 37. The valve strip 30 also has openings 38 in the form of slits, which are disposed centrally and at equal intervals between the adhesive layers 37 in the valve strip 30. In this case, the disposition of the other openings 31, 36 in the two layers 21, 22 is such that all the openings 31, 36, 38 are disposed offset from one another either laterally or longitudinally.

An exemplary embodiment of the overpressure valve 25 is also conceivable in which in addition to the characteristics just described and shown in FIG. 5, hot-melt points 33 are additionally employed as spacers between the valve strip 30 and the outer layer 22. In this case, the hot-melt points 33 are preferably disposed at the same level as the openings 31, 38 of the inner layer 21 and valve strip 30, respectively.

It is additionally noted that the form of the openings 31, 36, 38 may also be different; that is, not only plunge cuts or slits but also stamped-out openings, holes or other kinds of cuts may be advantageous, depending on the application. The favorable spacings and dispositions of the various openings 31, 36, 38 in the two layers 31, 22 and in the valve strip 30 should as a rule also be determined on the basis of series of experiments.

Laminates of this kind, described above, for such packaging containers as bag packages 10 can be produced by making the appropriate openings 31, 36 separately in the two layers 21, 22 before the lamination, and joining the layers 21, 22 together with the valve strip 30 in between them in such a way that the desired offset of the openings 31, 36, 38 relative to one another is brought about. In the lamination as well, the liquid sealant 35 is applied on the valve strip 30. When hot-melt points 33 are used, it is also necessary, when the valve strip 30 is introduced, to provide the hot-melt points 33 at the appropriate points.

The channel 27, and hence the overpressure valve 25, preferably extends longitudinally of the laminated layers 21, 22 of a side wall 11, 12, so that it can be in a simple way on known machines. However, the channel 27 may also extend transversely to the longitudinal direction, and in particular crosswise in the region of the head 13 of the bag package 10 (FIG. 6), which is especially advantageous whenever, as will be described hereinafter, the hot-melt points 33 are dispensed with.

It should also be noted that the channel 27 need not extend over the entire length or width of a bag package 10 but instead may extend only within a portion of one wall of the bag package 10.

The overpressure valve 25 of the above-described bag package 10 functions as follows:

When the pressure in the interior of the bag package 10 and in the atmosphere surrounding it is the same, and when there is a slight overpressure in the interior of the bag package 10, the valve strip 30 and the inner layer 21 in particular contact one another in the region of the channel 27; the openings 31 in the inner layer 21 are sealed off from the valve strip 30. The liquid sealant 35 contained in the channel 27 increases the tightness, so that the permeation of even small quantities of gas is prevented. If the gas pressure in the interior of the bag package 10 rises as a result of gas given off by the product in it and reaches a certain height, the gas is forced through the openings 31 of the inner layer 21 into the channel 27 and presses the valve strip 30 contacting the channel upward (FIG. 7). In the exemplary embodiment in which hot-melt points 30 are used in the foil or film laminate 20, the gas thereupon passes through the passageway regions 34 into the region of the openings 36 of the outer layer 22, creating communication between the inner openings 31 and the closest outer openings 36. Through this communication, gas can now flow out of the interior of the bag package 10 into the open.

Because a certain spacing between the two layers 21, 22 is created by the hot-melt points 31, the effect of the valve strip 30 that reinforces the valve region is increased still further, so that even if the bag package 10 is deformed as a result of strains in its side walls 11, 12, the openings 34 can always form.

In the exemplary embodiment of FIG. 6, in which the hot-melt points 33 in the foil or film laminate 20 are dispensed with, the gas in the event of an overpressure in the bag package 10 flows through the slits 38 in the valve strip 30 and through the openings 36 in the outer layer 22 into the open, the outer layer being lifted away from the valve strip 30 by the overpressure. In this case it is also possible to dispose the overpressure valve 25, or the channel 27, extending crosswise in the top 13 of the bag package 10.

Once a certain quantity of gas has been given off and the internal pressure in the interior of the bag package 10 drops, the valve strip 30 presses against the inner layer 21 again, so that the opening in the channel 27 closes again. This prevents oxygen from the air in the atmosphere from penetrating to the interior of the bag package 10.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A laminate (20) for producing packaging containers (10), comprising a multilayer packaging material having at least one flexible outer layer (22), and having an inner layer (21) in contact with a product in the package, wherein the inner and at least one outer layer (21, 22), are firmly joined together along one surface of each layer, except in a linear channel (27) in which a portion of the inner layer (21) loosely covers a portion of said at least one outer layer and openings (31, 36) are disposed in the channel (27) in each of the two layers (21, 22), and a flexible valve strip (30) is disposed in the channel (27), covers the openings (31) of the inner layer (21) and operates as a one-way valve, said flexible valve strip (30) includes openings (38) which are offset from the opening (31) in the inner layer and the openings (36) in the at least one outer layer.

2. The laminate for producing packaging containers as defined by claim 1, in which the flexible valve strip (30) is arranged along a center of the channel (27) and has a width less than the channel (27) between the inner and outer layers, and the flexible-valve strip is joined at least partially to at least one of the inner layer (21) and the outer layer (22), and when there is an overpressure in the packaging container (10), an open communication exists between the openings (38) in the valve strip (30) and the openings (31, 36) in the inner layer (21) and the at least one outer layer (22).

3. The laminate for producing packaging containers as defined by claim 2, in which the valve strip (30) in its peripheral region is joined partially by means of spacers (33) to at least one of the inner layer (21) and the at least one outer layer.

4. The laminate for producing packaging containers as defined by claim 2, in which the openings (31, 36) of the inner layer (21) and outer layer (22) are disposed offset from one another.

5. The laminate for producing packaging containers as defined by claim 2, in which the openings (31, 36, 38) are slits, cutouts, perforations, plunge cuts or holes.

6. The laminate for producing packaging containers as defined by claim 2, in which a liquid film, comprising a sealant (35), is disposed between the inner layer (21) and the valve strip (30).

7. The laminate for producing packaging containers as defined by claim 1, in which the valve strip (30) in its peripheral region is joined partially by means of spacers (33) to at least one of the inner layer (21) and the at least one outer layer.

8. The laminate for producing packaging containers as defined by claim 7, in which the width of the valve strip (30) is less than the width of the channel (27).

9. The laminate for producing packaging containers as defined by claim 7, in which the openings (31, 36) of the inner layer (21) and outer layer (22) are disposed offset from one another.

10. The laminate for producing packaging containers as defined by claim 3, in which the openings (31, 36, 38) are slits, cutouts, perforations, plunge cuts or holes.

11. The laminate for producing packaging containers as defined by claim 3, in which a liquid film, comprising a sealant (35), is disposed between the inner layer (21) and the valve strip (30).

12. The laminate for producing packaging containers as defined by claim 1, in which the width of the valve strip (30) is less than the width of the channel (27) and the openings (36) in the at least one outer layer are disposed on opposite sides of the valve strip (30).

13. The laminate for producing packaging containers as defined by claim 12, in which the openings (31, 36) of the inner layer (21) and outer layer (22) are disposed offset from one another.

14. The laminate for producing packaging containers as defined by claim 12, in which the openings (31, 36, 38) are slits, cutouts, perforations, plunge cuts or holes.

15. The laminate for producing packaging containers as defined by claim 1, in which the openings (31, 36) of the inner layer (21) and outer layer (22) are disposed offset from one another.

16. The laminate for producing packaging containers as defined by claim 15, in which the openings (31, 36, 38) are slits, cutouts, perforations, plunge cuts or holes.

17. The laminate for producing packaging containers as defined by claim 1, in which the openings (31, 36, 38) are slits, cutouts, perforations, plunge cuts or holes.

18. The laminate for producing packaging containers as defined by claim 1, in which a liquid film, comprising a sealant (35), is disposed between the inner layer (21) and the valve strip (30).

19. A packaging container in the form of a bag (10), comprising the laminate as defined by claim 1, having side walls (11, 12), a top region (13) and a bottom region (14), in which the channel (27) is disposed along a side wall (11, 12).

20. A packaging container as defined by claim 19, in which the channel (27) is disposed in the top region (13).

* * * * *